United States Patent [19]

Jacobs

[11] 4,281,425

[45] Aug. 4, 1981

[54] NEONATAL FLOTATION PAD

[76] Inventor: Annella E. Jacobs, 3648 S. Margarita Way, Las Vegas, Nev. 89103

[21] Appl. No.: 63,790

[22] Filed: Aug. 6, 1979

[51] Int. Cl.[3] ..... A47C 27/08; A61G 11/00

[52] U.S. Cl. ..... 5/455; 5/451; 128/1 B

[58] Field of Search ..... 5/451, 452, 455, 449, 5/450, 448; 128/1 B, 721

[56] References Cited

U.S. PATENT DOCUMENTS

| | | | |
|---|---|---|---|
| 2,803,115 | 8/1957 | Shepherd | 62/530 |
| 3,789,442 | 2/1974 | Tobinick | 5/451 |
| 3,810,265 | 5/1974 | McGrew | 5/451 |
| 4,048,684 | 9/1977 | Korner et al. | 5/451 |
| 4,079,728 | 3/1978 | Gatts | 128/1 B |
| 4,139,920 | 2/1979 | Evans | 5/455 |
| 4,163,297 | 8/1979 | Neumark | 5/455 |

*Primary Examiner*—Roy D. Frazier
*Assistant Examiner*—Alexander Grosz
*Attorney, Agent, or Firm*—Seiler & Quirk

[57] ABSTRACT

A flotation mattress pad for an incubator or open warmer has a plurality of separate transverse sections filled with a heat-retentive, viscous fluid. The center sections of the pad have a slightly greater thickness than the end sections. Each section overlaps the adjacent sections to provide relatively constant thickness when the pad is tilted.

9 Claims, 4 Drawing Figures

NEONATAL FLOTATION PAD

BACKGROUND OF THE INVENTION

This invention relates to a flotation pad or mattress for use in incubators and on open warmers for prematurely born infants. More particularly, and in a preferred embodiment, the invention relates to a heat retentive, fluid-filled incubator mattress having a plurality of sealed transverse compartments.

Neonatal care has developed into a highly specialized medical field. In particular, prematurely born babies have unique problems and require almost constant attention from hospital personnel. Depending on the actual gestation period, premature infants may spend many days or weeks in the controlled environment of an incubator. Despite this protective environment, the infant may be subject to certain physical discomforts caused simply by the tender, sensitive nature of its body. For example, a premature infant's head is relativley soft and pliable, and may conform to the shape of a flat, rigid mattress. Additionally, a premature infant's head is over sized relative to the rest of its body, and breathing difficulties may be encountered when the infant is positioned on its back because its chin tends to roll forward toward the chest, closing the windpipe. Excoriation of the limbs, particularly the knees and toes, is not uncommon because of the extreme softness of the baby's skin.

In addition to the aforementioned problems relating to neonatal care, maintenance of incubator temperature is of course quite critical. Therefore, failsafe electrical controls are important, and the incubator must be opened only as necessary for care and feeding. Nonetheless, it is virtually impossible to eliminate inflow of relatively cold air when the unit is opened.

The incubator flotation pad and pad support of the invention are designed to provide a safer and more stable incubator environment for prematurely born infants. The pad consists of a water impermeable, flexible bladder having at least four sealed transverse sections. Each section is fluid filled, preferably with a semi-viscous fluid having a high heat capacity. In a preferred embodiment, the transverse sections overlap each other longitudinally, to maintain a relatively uniform pad thickness when one end of the pad is elevated. In another aspect of the invention, the center sections of the pad are filled to a greater thickness than the end portions; the center sections support the infant's torso, whereas the end sections accommodate the baby's oversized head.

The inventor is not aware of any fluid-filled pads designed specifically for neonatal use. However, pads, mattresses, and other furniture containing water or other more viscous fluids have been known for many years. In the prior art, a number of patents have disclosed the desirability of a therapeutic fluid-filled mattress for the treatment of decubitus ulcers. In general, these patents disclose mattresses or bladders which are filled with a jelly or highly viscous fluid; examples of these patents are Graves, U.S. Pat. No. 3,689,948, McGrew, U.S. Pat. No. 3,810,265, Trenchard, U.S. Pat. No. 3,721,232, and Graves, U.S. Pat. No. 3,858,379. These patents are not specifically directed to problems related with neonatal care, nor do they disclose the particular features of the invention.

The particularly preferred fluid material of the invention is a mixture of starch, borax, and water commonly marketed as a gel refrigerant under the tradename "Blue Ice". The compositions, methods of manufacture, and common methods of packaging of this material are disclosed in a series of patents U.S. Pat. No. 2,800,454, U.S. Pat. No. 2,800,455, and U.S. Pat. No. 2,803,115, all issued to J. C. Shepherd. While these materials are known refrigerants, it has been found that they are also of suitable viscosity at the incubator temperature of 98° F., and also have a high heat capacity, i.e., excellent heat retentive properties, thereby tending to compensate and dampen any temperature fluctuations which may occur within the incubator unit.

Accordingly, it is an object of the invention to provide a flotation pad for a neonate which will conform to the shape of the infant's body, and which will be sufficiently soft to minimize abrasion of the infant's skin. It is yet a further object of the invention to provide an incubator flotation pad which is shaped to accommodate the large head size of a premature infant. It is still another object of the invention to provide a flotation pad having a plurality of sections to minimize accumulation of fluid at one end of the pad when the pad is elevated. Another object of the invention is to provide a fluid-filled pad having heat retentive qualities to minimize variations of the incubator temperature. These and other objects of the invention will be apparent from the following detailed description of a preferred embodiment thereof.

SUMMARY OF THE INVENTION

A flotation pad for an incubator or open warmer for premature infants comprises a fluid-filled, impermeable, flexible bladder having a plurality of separately sealed transverse compartments. The compartments in the pad are filled with fluid in quantities such that the central portion of the pad has a greater thickness than the end portions.

BRIEF DESCRIPTION OF THE DRAWINGS

The invention is best understood with reference to the drawings, in which.

DETAILED DESCRIPTION OF A PREFERRED EMBODIMENT

Figure 1:
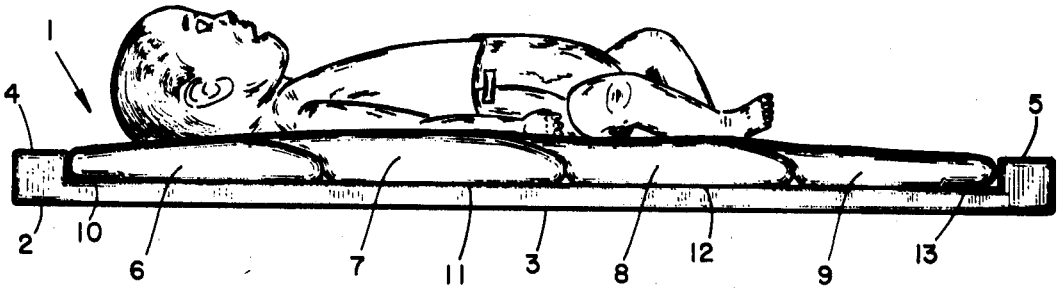
FIG. 1 is a side view of a flotation pad and pad support of the invention, with an infant supported thereon.

Referring to FIG. 1, a flotation pad 1 is shown resting on pad support 2. The pad, shown in side view, is uniform across its cross section and is fabricated from a dense flexible foam material, such as polyurethane. The pad has a flat bottom portion 3 designed to rest on the bottom of the incubator, and has slightly upraised flange portions 4 and 5 on the ends thereof to hold the ends of the flotation pad. The sides of the pad are open to permit easy access to the pad, for example, for wrapping a blanket or sheet around the pad before placing it on the pad support.

Figure 3:
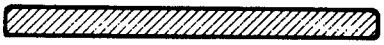
FIG. 3 is a transverse cross-section of one of the compartments.

The flotation pad consists of four transverse sections 6, 7, 8, and 9, each of which is fluid-filled and entirely sealed. Each unit or compartment is a water impermeable flexible bladder 10, 11, 12, and 13, fabricated from a suitable synthetic material such as vinyl or polypropylene, generally from about 1 to about 4 mils, preferably from 1.5 to 2 mils, thickness. The bladder should be sufficiently thick and tough to prevent leakage and to be resistant to punctures, e.g., from safety pins, yet thin and pliable enough to conform to an infants rounded head. Each compartment is of approximately rectangular transverse cross-section, as shown in FIG. 3.

The particular shape and thickness of the flotation pad of the invention is quite important. First of all, the center sections of the flotation pad are filled to a slightly greater thickness than the end sections. The amount of overfill is sufficient to make the center sections of the pad at least 10%, more preferably 15%, and still more preferably at least 20% greater in thickness than the end sections. When the infant lies on the pad as shown in FIG. 1, the flexible nature of the pad and the fact that the pad is thicker in the center than at the ends enables the infant's head to tilt slightly backward, thereby insuring that the windpipe will not be closed off by a raised position of the head. Use of the mattress shifts the pressure on the baby's head to the occipital areas, and the softness and flexibility of the pad precludes any flattening of the head.

Figure 2:
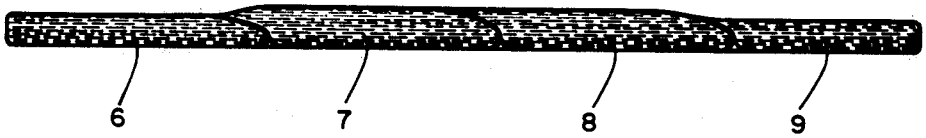
FIG. 2 is a side section view of a pad showing four separate compartments.
Figure 4:
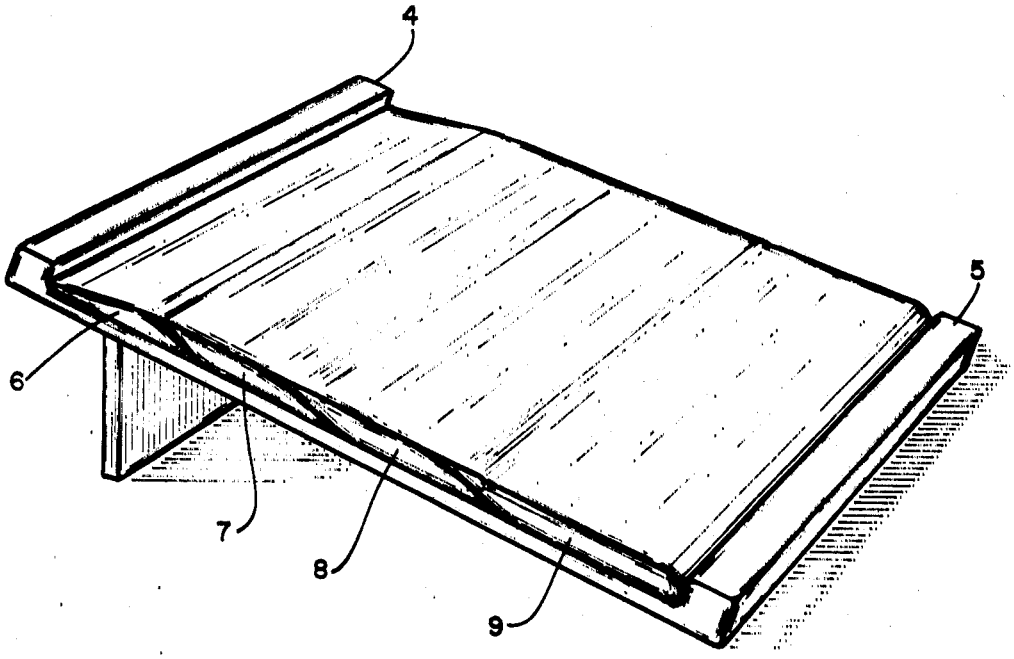
FIG. 4 is a side elevational view of the pad support and the flotation pad, showing one end of the flotation pad in elevated condition.

In addition to having a slightly greater thickness near the center of the pad, the pad is constructed with overlapping bladder sections as shown in FIGS. 1 and 2 to preclude drainage of the liquid material to one end of the pad if the other end is raised. The pad sections are slightly envelope-shaped in longitudinal cross-section, with the end of one envelope overlapping the adjacent envelope to the extent of at least 10 percent, and preferably one-quarter to one-third of the length of the bladder, the length dimension of each section being referred to as the dimension along the length of the pad as shown in cross-section in FIG. 2. As shown in FIG. 4, as one end of the pad support is elevated, the fluid material flows by gravity down the length of the pad toward the bottom. Because of the compartment overlap, thickness lost through the draining down from the upper portion of each envelope is replaced by thickness added from the bottom portion of the next adjacent envelope. Accordingly, the thickness of the pad is not varied significantly when one end thereof is elevated. The same effect could of course be obtained by having a very large number of transverse sections. Preferably, there are at least four sections per pad; three sections has found to occasionally create an inordinate "bulge" effect in the center section. A very large number of sections, e.g., more than ten, is unnecessary and may be undesirable, since the fluid may not have sufficient distance to travel to provide total conformity with the shape of the infant's body.

While the pad is sized to fit an incubator, a typical size is approximately 22" long by 13" wide by 1" thick.

The flotation pad of the invention may be filled with water, but is preferably filled with a more viscous, heat retentive fluid. The particularly preferred fluid is the gel type material containing starch, borax, and water disclosed in Shepherd, U.S. Pat. No. 2,800,454. This material is a gel at room temperatures and is preferably partially diluted with water, e.g., by 10 to 40%, to ensure proper fluidity. Preferably, the gel is made with an aldehyde as disclosed in the Shepherd patent to ensure indefinite stability. The desired proportions of the components is set forth in the Shepherd patent. As an example, the gel may consist of about 100 parts of pregelatinized starch, 300 to 1200 parts of water, from 3 to 100 parts of borax, and between 1 and 100 parts of formaldehyde. A specific example is a gel consisting essentially of 100 parts of pregelatinized starch, 25 parts of borax, 3 parts of paraformaldehyde, and 800 parts of water, all parts being measured by weight. Other water thickening agents, such as carboxypolymethylene, may also be used. Polyvinyl alcohol gels of the type described in the Graves patents mentioned above are also suitable. The materials should be liquid (not gelatinous) at room temperature, and gels should be diluted with water until liquid.

In a preferred embodiment of the invention, the center sections of the support pad are filled to a slightly greater level, or have a slightly greater thickness, than the end sections. In a pad containing four sections, the two center sections, comprising 50% of the length of the pad, have larger thicknesses. In pads having more than four sections, or in pads having sections of differing lengths, the center portion amounting to at least 40% and preferably at least 50%, generally from 50% to 70% of the length of the pad, have an increased thickness. The increased thickness is for the purpose of supporting and elevating slightly the infant's trunk, permitting the back of the infant's head to rest at a slightly lower level than the body; therefore, to accommodate this purpose, only one end of the mattress need have a smaller thickness than the remainder of the pad. In most cases, however, the pad is made symmetrical so that it may be reversed without concern as to placing the infant's head at the proper end.

The flotation pad of the invention is used as follows. First, the pad is warmed on an open warmer with a control set at 98° F. A heat probe is preferably used to avoid overheating. The pad is then loosely covered with an infant blanket and set in the incubator or on an open warmer. The infant should be set directly on the blanket; additional layers of materials between the pad and the infant create flat surfaces which will tend to misshape the infant's head. The infant is then positioned on the pad with its head on the upper quarter of the pad. If the infant is particularly small, e.g., less than 1,000 grams, it may be necessary to further increase the thickness of the pad in the center portion by placing additional support, e.g., a folded diaper, under the center portion of the pad to maintain the head in extended position. The pad is particularly useful if the infant is intubated or is not on oral feedings, since the pad helps to support the head with the face in a straight up position.

Various changes, modifications, or additions of the incubator flotation pad of the invention are possible and will be apparent to those skilled in the art. Accordingly, while the invention has been described with respect to a preferred embodiment thereof, the invention should not be considered limited by the foregoing description, but rather should be defined only by the following claims.

I claim:

1. A flotation pad for premature infants comprises a unitary liquid-impermeable, flexible bladder having a plurality of adjacent separate fluid-containing sealed transverse compartments, wherein each compartment is in overlapping relationship with the next adjacent compartment in the amount of at least 10% of the length of each compartment, such that when the pad is tilted, the thickness thereof remains relatively uniform.

2. The pad of claim 1 wherein the thickness of the center compartments of the pad is greater than the thickness of the end compartments.

3. The pad of claim 2 wherein the thickness of the center compartments is at least 10% greater than the thickness of the end compartments.

4. The pad of claim 2 wherein the thicker compartments extend at least 50% of the length of the pad.

5. The pad of claim 1 wherein the bladder contains at least four compartments.

6. The pad of claim 1 also comprising in combination therewith a soft, structural pad support having a flat base portion and raised end portions.

7. The pad of claim 1 wherein the fluid contained in the compartments is a viscous, water based, heat retentive fluid.

8. The pad of claim 1 wherein the fluid contained within the compartments is a gel comprising water, starch, borax, and paraformaldehyde.

9. A flotation pad for premature infants comprises a unitary, liquid-impermeable, flexible bladder having a plurality of adjacent separate fluid-containing sealed transverse compartments wherein each compartment is in overlapping relationship with the next adjacent compartment in the amount of at least 10% of the length of each compartment, such that when the pad is tilted, the thickness thereof remains relatively uniform, and wherein the thickness of center compartments is at least 10% greater than the thickness of end compartments, said thicker compartments extending at least 50% of the length of the pad, said pad comprising in combination therewith a soft, structural pad support having a flat base portion and a raised end portion.

* * * * *